US005525084A

United States Patent [19]

Broadbent et al.

[11] Patent Number: 5,525,084

[45] Date of Patent: Jun. 11, 1996

[54] UNIVERSAL QUADRUPOLE AND METHOD OF MANUFACTURE

[75] Inventors: Carolyn C. Broadbent, Los Altos; Jeffrey T. Kernan, Mountain View; Jean L. Truche, Los Altos, all of Calif.

[73] Assignee: Hewlett Packard Company, Palo Alto, Calif.

[21] Appl. No.: 218,441

[22] Filed: Mar. 25, 1994

[51] Int. Cl.[6] ..... H01J 1/88

[52] U.S. Cl. ..... 445/49; 250/292

[58] Field of Search ..... 445/49; 250/292, 250/293

[56] References Cited

U.S. PATENT DOCUMENTS

| | | | |
|---|---|---|---|
| 3,699,330 | 10/1972 | McGinnis | 250/281 X |
| 3,793,063 | 2/1974 | Wiley | 250/293 X |
| 3,819,941 | 6/1974 | Carrico | 250/281 |
| 4,213,557 | 7/1980 | Franzen et al. | 228/122 |
| 4,885,500 | 12/1989 | Hansen et al. | 313/256 |
| 5,298,745 | 3/1994 | Kernan et al. | 250/292 |

OTHER PUBLICATIONS

"Innovative Design—Unique Mass Filter"; Sources Unknown.

*Primary Examiner*—Kenneth J. Ramsey

[57] ABSTRACT

The present invention provides a method and apparatus for formation of a quadrupole electrode assembly for a mass spectrometer. The quadrupole electrode assembly is comprised of an outer elongate tube having an internal and external surface where the outer elongate tube as the outermost structure may be used for supporting a vacuum and an electrode structure fused to the internal surface of the outer elongate tube. Typically there are four electrodes where each electrode includes an arced region having a conductive surface where the arcs are aligned in parallel opposing pairs equidistant from a central axis. In the preferred embodiment, the four electrode structures are four cylindrical glass tubes where the curvature of the arc approximates a hyperbola. At least a portion of the surface of the arc is a conductive region typically formed by applying a metal coating to the surface of the glass tube. The arced region of the electrode may be a hyperbola formed by placing the electrode structure in proximity to a first hyperbolic surface and modifying the shape of the electrode structure by heating the structure to its softening point. In response to a pressure differential, the structure expands to conform to the first hyperbolic structure.

7 Claims, 12 Drawing Sheets

UNIVERSAL QUADRUPOLE AND METHOD OF MANUFACTURE

BACKGROUND OF THE INVENTION

The present invention relates to mass filters, including quadrupole mass filters and more particularly to a glass quadrupole electrode assembly for a mass spectrometer.

Mass filters are tools for analyzing the chemical composition of matter, for example by using electric fields to separate ionized particles by their mass-to-charge ratios. High filtering resolution has been achieved using quadrupole mass filters that include four parallel elongated electrodes. The ideal cross section for the elongated electrodes approximates four hyperbolic arcs extending in their respective quadrants to infinity about a common origin. Generally, only the hyperbolic arcs near the origin are approximated.

FIG. 1 shows a four metal rod implementation of a quadrupole filter. The hyperbolic electrode surfaces are typically formed by grinding the hyperbolic shape from solid metal, e.g., molybdenum or stainless steel rods. The desired arrangement of the four ground rods is then maintained by harnesses of ceramic or other rigid, nonconductive materials.

However, there are several disadvantages to the metal rod implementation of a quadrupole filter, e.g. expense, weight, bulk and vulnerability to misalignment. Grinding identical hyperbolic surfaces on four several inch long molybdenum rods is costly both in terms of time and materials. Further, only the hyperbolic surface is electrically useful. The bulk of the metal rod serves only limited functions such as providing rigidity. Further if the four rods in ceramic harnesses are jolted, misalignment can easily occur. This misalignment may be undetectable by an unaided eye and yet can unpredictably distort the resulting spectra.

One approach which eliminates some of the problems associated with the four metal rod implementation of the quadrupole filter is disclosed in U.S. Pat. No. 4,885,500 to Hansen, et al. U.S. Pat. No. 4,885,500 discloses a glass quadrupole where the electrode assembly structure is provided by an appropriately shaped glass tube which serves as a substrate for the quadrupole. The conductive electrodes are achieved by fusing thin strips of metal to the hyperbolic contours of the inner surface of the glass tube.

The use of a glass quadrupole greatly reduces the size and weight due to the substitution of glass and thin metal strips for the rods in the metal rod implementation. Cost and labor is greatly reduced since glass can be 1) economically obtained and 2) be formed by vacuum formation over a mandrel. The cost and time involved for the formation of a glass quadrupole using a reusable mandrel is reduced compared to the cost and time involved in grinding four metal rods per mass quadrupole filter.

Further, glass tends to be less susceptible than quadrupole metals to small and elastic deformations, so that valid spectra are generally obtainable except when the structural integrity of the glass is breached. Damage to a glass quadrupole is more readily detected visually than damage to a metal quadrupole. Thus, there is less likelihood of a damaged glass quadrupole being operated under the impression that it is providing valid spectra.

Although a glass quadrupole alleviates some of the problems associated with the standard metal rod implementation, there are still problems associated with the glass quadrupole described in U.S. Pat. No. 4,885,500. One problem associated with the mass quad filter described in the aforementioned patent is electrical charge accumulation at the interface between the conductive poles and the insulating dielectric cusps. This accumulated charge creates electric fields that distort the mass selection fields created by the poles.

Ideally the cusp between conductive poles should be infinite to eliminate the effect of charge distortion. Because the cusp distance between the poles are truncated near the active filtering region, the electric field distortion is aggravated. The charge build up is further aggravated at high voltages where the charge cannot dissipate at a rate faster than charge is generated.

A second problem with the glass quadrupole disclosed in U.S. Pat. No. 4,885,500 is field emissions which occur at the interface between the conductive poles and the dielectric. A high voltage at the pole-dielectric interface may result in electron discharge from the conductive material at the pole-dielectric interface into space in the regions surrounding the interface. This electron discharge distorts the axial field and can have secondary ionizations. Electric field distortion is aggravated when the distance between the central axis and the pole-dielectric interface is small.

Other problems associated with the quadrupole described in U.S. Pat. No. 4,885,500 are related to manufacture of the conductive poles. It is difficult to get a smooth edge where the conductive metal strip meets the dielectric and the metal edge is often jagged. The jagged metal edge increases the probability of field emissions at the conductive pole/dielectric interface.

Both the metal rod quadrupole and glass quadrupole disclosed in Hansen et al. are placed inside a vacuum chamber during operation of the mass filter. FIG. 1 shows a isometric view of a mass filter having a four rod electrode assembly. The mass analyzer assembly includes a mass filter assembly 110, an ion source 112 and a detector 114. The quadrupole assembly 110 is enclosed in a chamber 116 to which a vacuum is applied. Electrical connections to a power supply are made through openings 118, 120.

Inherent to a vacuum and the choice of methods and materials used to contain a vacuum, is consideration for diffusion of gases through materials, adsorption and desorption of gases from the surfaces as well as leak paths between surfaces. Additionally, consideration for trapped air, water or other contaminants present between internally mating parts is important as the resulting virtual leaks will adversely affect ion transport and detection. The greater the surface area present in the vacuum and the greater the number of trapped volumes between parts, the greater the degradation in the vacuum and thus in the quality of spectra.

The quadrupole assembly of the mass filter is typically connected to an ion source and an ion detector. Because ion sources and detectors are not standard in size, the interface between the ion source and the quadrupole and the quadrupole and the ion detector must be specifically designed to mate with each quadrupole. A modular design which allows different ion sources and ion detectors to be coupled to the quadrupole assembly is needed.

A mass filter which provides the size, bulk, cost and reliability advantages of a glass quadrupole, yet reduces the effects of charge accumulation and field emissions, improves reproducibility, and which allows for superior vacuum integrity without sacrificing mass filter performance is needed. Concomitantly, it is the objective of the present invention to provide a method of manufacturing such a glass quadrupole.

SUMMARY OF THE INVENTION

The present invention provides a glass quadrupole mass filter electrode assembly which provides the advantages of a glass quadrupole yet reduces the effects of charge accumulation and field emissions, improves manufacturability and vacuum integrity without sacrificing performance.

The electrode assembly is comprised of an outer elongate tube, and four structures coupled to the outer elongate tube. The four structures include an arced region having a conductive surface where the arced regions are aligned in parallel opposing pairs with a central axis. The outer elongate tube is glass and the four structures are four cylindrical glass tubes where the curvature of the arced region approximates a hyperbola. The four structures may be fused to the outer elongate tube using an adhesive. Alternatively, the four structures may be fused to the internal wall of the outer elongate tube by heating the four structures to the softening point of the four structures while in proximity to the outer elongate tube. At least a portion of the surface of the arc is a conductive region formed by depositing or fusing a metal layer on at least the arced region of the four structures.

The structure of the electrode assembly described in the present invention reduces the effect of charge accumulation and electron discharge by increasing the distance between the pole-dielectric interface and the central axis of the desired field. Compared to previous quadrupoles, the interface of conductive and nonconductive material is farther from the central axis causing less distortion to the electric field. The central axis is where the majority of charge particle separation occurs. Increasing the distance between the pole-dielectric interface and the central axis of the quadrupole assembly decreases the distorting effect of the accumulated electric charge on the mass selection field. The distortion on the mass selection field is decreased since the amplitude of the distortion field created by the pole-dielectric interface decreases with approximately the square of the distance from the pole-dielectric interface. Another advantage of the present invention is the absence of a line of sight between the pole-dielectric interface and the central axis of the quadrupole mass filter. Because there is no direct line of sight, the effect of field emissions on the mass selection field is decreased.

In the preferred embodiment, the outer elongate tube of the electrode assembly is used as the outermost structure for supporting the vacuum. Electrical interconnections to an external power supply are made through the surface of the outer elongate tube by metal feedthrough pins. The means for electrical interconnection, the metal feedthrough, is a preformed conductive material which extends through the sidewall of the outer tube to contact the conductive region of the four internal structures. Contact to the conductive region of the four structures provides electrical interconnection to the four electrodes.

It is believed that one reason glass quadrupole assemblies have not been used to support a vacuum in the past is that the confined geometry of the quadrupole assembly itself would prohibit adequate conductance to maintain sufficient vacuum. In addition, using previous quadrupole assemblies to support a vacuum is undesirable since all molecular flow would occur through the active region of the quadrupole. The present invention includes a number of peripheral areas which are not active quadrupole areas for improved flow of carrier and ancillary gases.

The quadrupole mass filter electrode assembly is manufactured by the steps of: positioning four structures inside an outer elongate tube having an internal and external surface, each of the four structures including an arced region where at least a portion of the arced region has a conductive surface, the four structures being positioned so that the arced regions are aligned in parallel equidistant opposing pairs with a central axis, and fusing the four structures to the internal wall of the outer elongate tube.

In the preferred embodiment, the arced region of the electrode structures has a preformed hyperbolic shape formed by placing each of the four structures in proximity to a first surface which is generally hyperbolic in cross section. In one embodiment, the first surface is the surface of a mold. In another embodiment, the first surface is the surface of a mandrel. The mold or mandrel is then heated to at least the softening point of the four structures. Because the internal pressure of the four structures is higher than the pressure in the region external to the four structures, the four structures balloon out slightly to conform to the shape of the mold or mandrel.

The present invention improves quadrupole mass spectrometer manufacture by improving instrument to instrument consistency and device maintenance. Similar to the prior glass quadrupoles, instrument consistency is improved because formation of the glass quadrupole is formed using a reusable tool. However, problems with metal tape consistency and adhesion are eliminated by using chemical vapor deposition to form the conductive regions of the electrode. Formation of the conductive regions by chemical vapor deposition results in more uniform metal layers. Further, using chemical vapor deposition minimizes the jagged edges which occur at the pole-dielectric interface.

Quadrupole cleanliness is key to its ability to perform as an accurate and reliable filtering device. Typically the quadrupole is cleaned by electrically disconnecting the quadrupole, removing the quadrupole from the mass spectrometer, exposing the metal rods to a cleansing solution, remounting the quadrupole to the mass spectrometer, and reconnecting the quadrupole. Because of the number of electrical interconnections, this is a time consuming procedure. Further, opening the mass filter to remove the quadrupole for cleaning exposes the vacuum chamber and all other internal surfaces to contaminants.

The glass quadrupole described in the present invention improves device maintenance by simplifying quadrupole removal and improving the cleaning process. First, quadrupole removal is simplified by reducing the number of mechanical interconnections making it easier to remove the quadrupole assembly. Further, using the outer glass tube to support a vacuum allows electrical interconnections to the quadrupole electrodes to be made through the sidewall of the outer glass tube reducing the number of electrical interconnections.

An additional advantage of the present invention over the four rod implementation of the electrode assembly is that the glass surface is easier to clean than the metal rod surface. Metal rods are difficult to clean because of surface voids and roughness. In contrast, glass quadrupoles described in the present invention may be cleaned simply by placing the glass quadrupole in a high temperature furnace or alternatively, by cleaning the quadrupole by known aqueous or solvent cleaning techniques.

In one embodiment, the present invention can be cleaned in situ, without removal of the glass quadrupole assembly. In order to clean in situ, a heating unit coupled to the quadrupole is turned to a temperature higher than the operating temperature of the mass filter. Increasing the temperature of the heater above the operating temperature causes contaminants adhering to the glass to be released from the glass surfaces. Contaminants released from the surface of quadrupole are eliminated from the quadrupole area.

A further understanding of the nature and advantage of the invention described herein may be realized by reference to the remaining portions of the specification and the attached drawings.

DESCRIPTION OF THE PREFERRED EMBODIMENTS

The present invention provides an electrode assembly and a method of manufacturing an electrode assembly. The quadrupole electrode assembly is comprised of an outer elongate tube having an internal and external surface, and four structures fused to the internal surface of the outer elongate tube, the four structures having at least a first region fused to the internal wall of the outer elongate glass tube and a second region forming an arc, the second region having a first conductive surface, the arcs being aligned in parallel equidistant opposing pairs with a central axis. In the preferred embodiment, the outer elongate tube is comprised of glass and the four structures are four cylindrical glass tubes where the curvature of the arc approximates a hyperbola. At least a portion of the surface of the arc is a conductive region typically formed by applying a metal conductive layer to the surface of the glass tube.

The method of formation of a quadrupole electrode assembly includes the step of positioning four structures internal to the outer elongate tube surface. The four structures typically include a first base region and a second arced region. The four structures are positioned so that a conductive surface of the second arced regions of the four structures are aligned in parallel equidistant opposing pairs with a central axis. The four structures may have a surface generally circular in cross section or alternatively may have another preformed surface.

In the preferred embodiment, the electrode structure has a preformed hyperbolic shape made by placing a structure in proximity to a first surface which is generally hyperbolic in cross section. The electrode structure is modified by heating the structure to its softening point. In response to a pressure differential, the structure expands to the shape of the hyperbolic surface. Although in the preferred embodiment the first surface is a hyperbola, other surfaces may be used. For example, the first surface may be generally circular or elliptical in cross section. In some embodiments, the electrode structure is modified before placement inside the outer elongate tube. In the embodiment shown in FIGS. 2A and 2B, the electrode structure is modified after positioning the electrode structures inside the outer elongate tube.

Figure 2A:
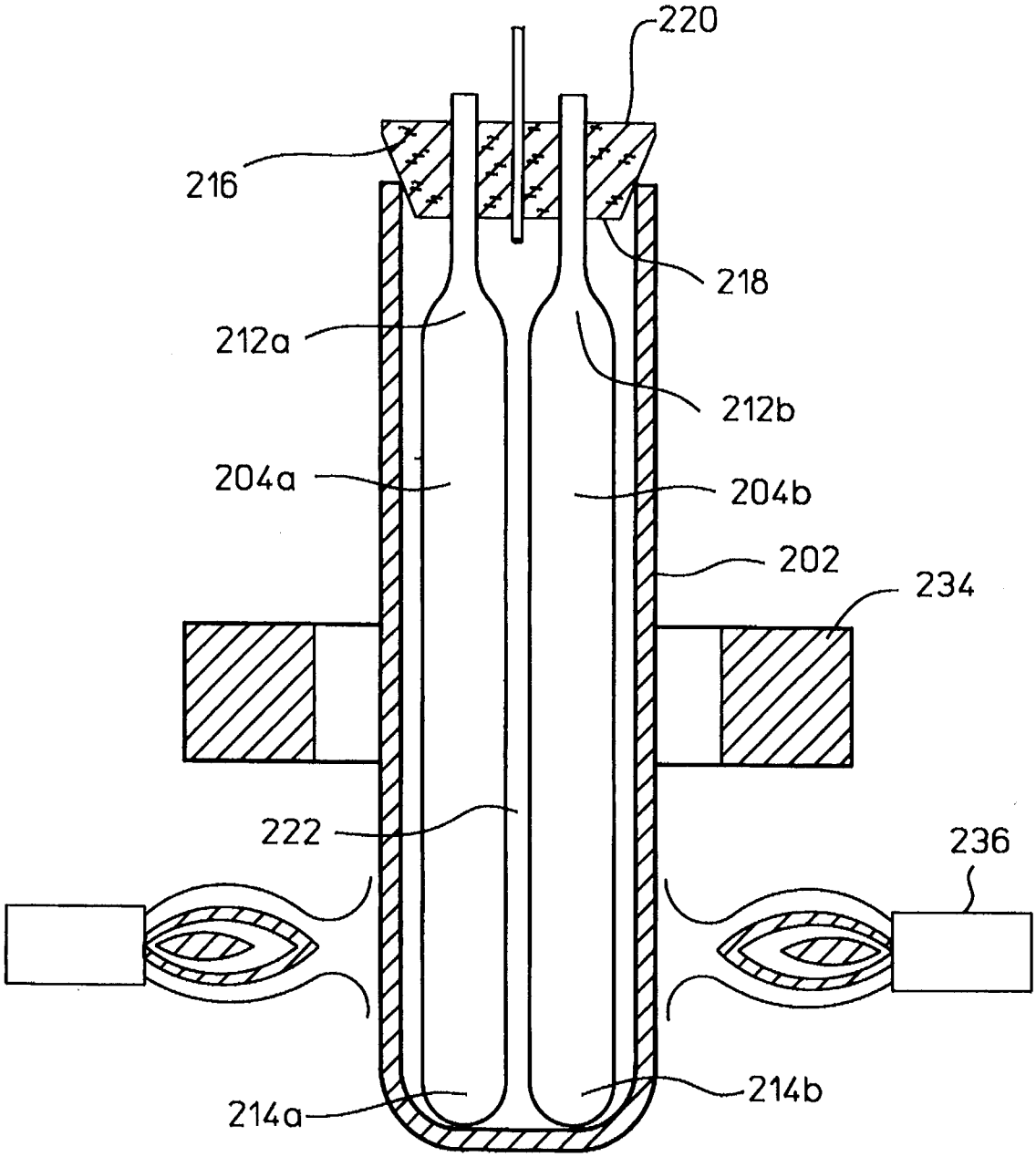
FIGS. 2A–2E illustrate the process configuration for one embodiment of the present invention.
Figure 2B:
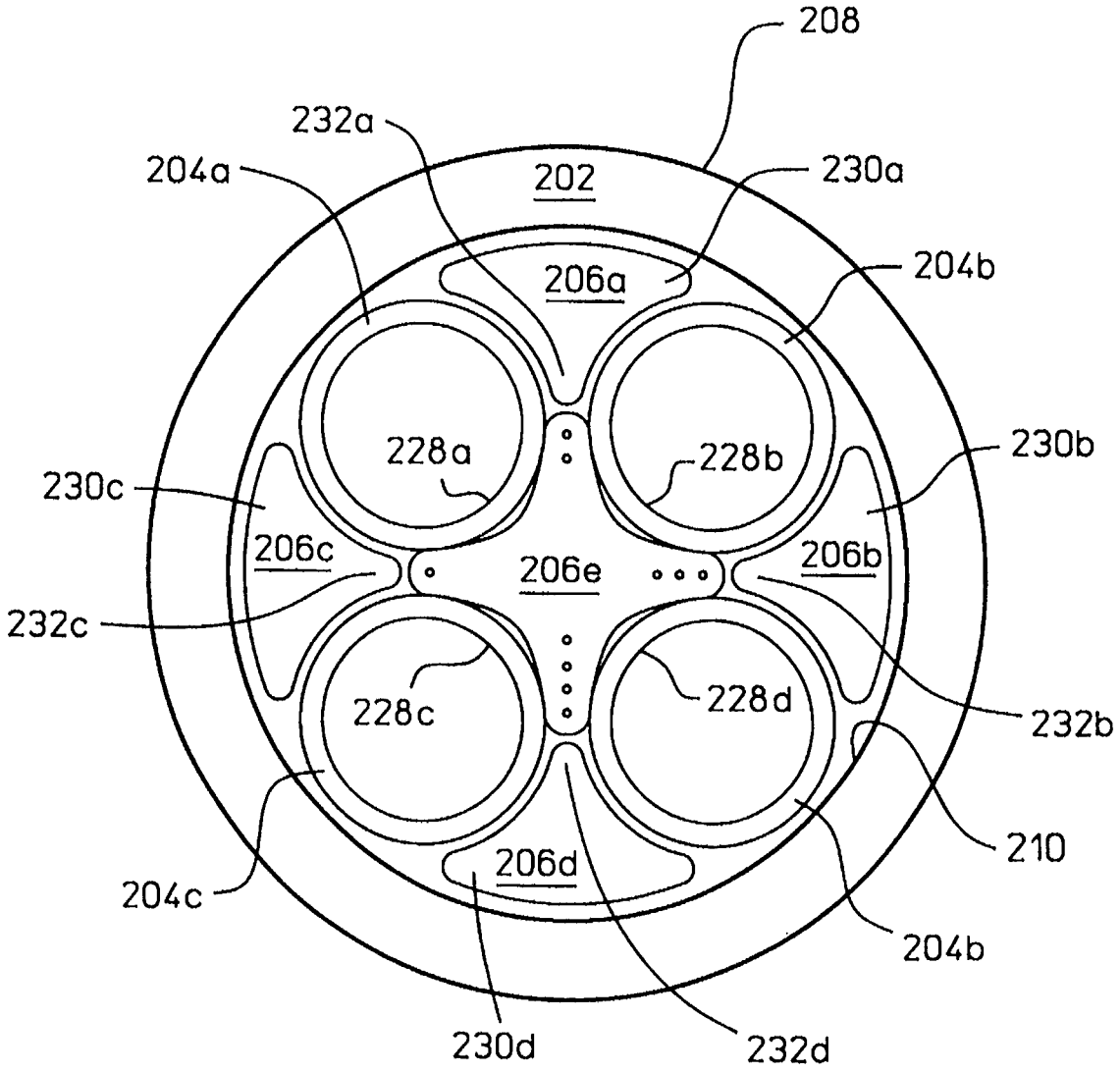

FIGS. 2A and 2B show the structure after the step of positioning the four structures inside the outer elongate tube. In the embodiment shown in FIG. 2, both the outer elongate tube 202 and the four structures 204*a*, 204*b*, 204*c*, and 204*d* are glass elongate tubes having an open and closed end. FIG. 2A shows a side view of two of the four inner elongate tubes 204 positioned inside the outer elongate tube 202 before the step of fusing the four inner tubes 204 to the outer elongate tube 202. In the configuration illustrated in FIG. 2A, the central mandrel 206*a* and side mandrels 206*b*, 206*c*, 206*d*, and 206*e* are not shown for improved visualization.

In the preferred embodiment, the outer elongate tube and the four inner structures formed of quartz, herein defined as glass having a silica content of at least 90%. Three exemplary quartzes are: a quartz with 96.5% silica, 3% borate and 0.5% alumina; fused silica, which is pure silica but for trace amounts of water (99.9% $SiO_2$, 0.1% $H_2O$); and ultra-low expansion titanium silicate, 93% silica, 7% $TiO_2$. Alternatively, the outer elongate tube or inner structures may be comprised of borosilicate glass, other ceramic materials or any suitable material of acceptable electrical properties to minimize RF losses. Alternatively, the outer elongate tube and inner four structures may be comprised of a conductive material.

As can be seen in FIGS. 2A and 2B, four thin walled small bore quartz tubes 204*a–d* are placed inside a larger outer elongate quartz tube 202. Typical dimensions of the outer cylindrical structure 202 shown in FIG. 2 are 50.0 mm for the outer diameter and 44.0 mm for the inner diameter. Typical dimensions for the inner four tubes 204 are 16.0 mm for the outer diameter and 14.0 mm for the inner diameter. Thus the thickness of the outer tube 202 is approximately 3.0 mm while the thickness of the inner four structures 204 is approximately 1.0 mm. Typically the sidewalls of the four inner tubes 204 are thinner than the sidewalls of the outer tube 204. The thinner sidewalls of the inner quartz tubes 204 allow the inner quartz tubes 204 to become malleable and conform to the surface of the central mandrel 206*a* while the outer tube 202 remains more rigid during fusure.

In the preferred embodiment, the shape of both the inner and outer tubes 204 and 206, respectively, is a cylinder having a circular cross section. However, other shapes are possible. For example, the tubes may have an oval or square cross section. Alternatively, the outer glass tube may have one shape while the inner glass tubes have a different shape in cross section. For example, the outer glass tube may have a square cross section while the inner glass tubes are generally circular in cross section. The important constraint for the shape of the glass structures is provision of a shape which allows alignment of the four inner glass tubes inside the outer glass tube in a position so that an arced region of the inner glass tube forms parallel opposing pairs around a central axis where the parallel opposing pairs are equidistant around the central axis.

In the embodiment shown in FIG. 2A, the initial length of both the outer tube 202 and the inner tubes 204 is approximately 1 meter. The inner glass tubes 204 include a necked region 212, opposite to the closed end 214 of the inner glass tubes 204. Although in the embodiment shown in FIG. 2A the length of the inner and outer glass tubes is approximately 1 meter, the length of the outer and inner glass tubes 202, 204 which form the glass quadrupole may vary as the length of the outer and inner glass tubes 202, 204 is dependent on the specifications desired for the mass spectrometer.

Typically a stopper 216 is positioned at the mouth of the outer elongate tube 202. Typically the stopper 216 is comprised of rubber but could be any material or combination of materials which would allow a vacuum tight seal. The stopper 216 is used to allow air flow into and out of the glass tubes 202, 204 and to seal the outer tube to allow vacuation. The stopper 216 typically has five openings which extend from a stopper surface 218 internal to the outer tube 202 to a stopper surface 220 external to the outer tube 202. Four of the five openings correspond to the four inner glass tubes 204 and help maintain position of the four inner structures 204. In the fifth opening, glass tubing or other connecting means is inserted. The glass tubing is connected to a vacuum pump (not shown) and is used to maintain a vacuum in the region internal to the outer glass tube and external to the inner four tubes. Although typically the four structures 204 are left open so that the internal pressure of the four structures 204 is at atmosphere, flexible tubing may be attached to the open end of the four structures 204 so that a pressure relief valve may be attached to provide a predetermined pressure internal to the four structures 204.

FIG. 2B shows a top cross sectional view of the positioning of the four structures 204 internal to the outer elongate tube 202 prior to the fusing step. The four structures 204 should be positioned proximate to the internal surface of the outer elongate tube 202 so that the base region of the four structures 204 contacts or nearly contacts the internal surface of the outer elongate tube 202. The embodiment shown in FIG. 2B includes five precision ground mandrels 206*a*, 206*b*, 206*c*, 206*d*, 206*e*. The mandrels 206 used must be able to maintain their integrity through repeated exposures to the elevated temperatures used to form the quadrupole. Mandrels 206 are typically comprised of refractory metals or ceramic based materials, such as molybdenum, tungsten, $Al_2O_3$, zirconium phosphate or an alloy of hafnium, carbon and molybdenum (HCM). The mandrels' external dimensions correspond to the internal dimensions of the substrate at formation temperatures.

The central mandrel 206*e* is used to conform the surface of the inner tubes in proximity with the surface of the mandrel to achieve a hyperbolic contour. The central mandrel 206*e* is positioned proximate to the second region 228*a–d* of all four inner tubes. Four side mandrels 206*a–d* are positioned between each of the four inner tubes 204. Each of the four side mandrels 206*a–d* is placed between the subsequently formed conductive region of two adjacent glass inner tubes 204. In the embodiment shown in FIG. 2B, the side mandrels 206*a–d* have a base 230 and apex 232 region. The base region 230 narrows to an apex region 232 which separates the sides of the two adjacent glass tubes to prevent contact of the subsequently formed conductive regions of the inner tubes during fusure. The side mandrels 206*a–d* are positioned so that the base region 230 is proximate to or contacts the internal surface 210 of the outer tube. The width of the base region 230 of the side mandrels 206*a–d* should allow the inner tubes to contact the internal surface of the outer glass tube and at the same time prevent contact between the subsequently formed conductive regions of adjacent inner tubes 204.

After the four inner tubes 204 are properly positioned inside of the outer glass tube 202, the four inner tubes 204 are fused to the internal surface 210 of the outer tube 202. Typically, fusing the inner tubes 204 to the outer tube 202 is performed by heating the properly positioned structure to the softening point of the inner tube material. The softening point of quartz is approximately 1550° C. However, fusure of the inner tube to the outer tube may refer to any manner which binds or couples the inner tubes 204 to the outer tube 202 in a mechanically stable fashion. For example, in an alternative embodiment the inner tubes 204 are fused to the outer tube 202 by a ceramic adhesive or fiber optic grade epoxy. Alternatively, the inner tubes 204 may be screwed, or by other means fastened, onto the outer tube 202.

Heating the properly positioned structure to the softening point of the inner tubes 204 is typically done using a direct flame 236, or a combination of a direct flame 236 and an induction heater 234, typically to a temperature between 750 and 1550 degrees Celsius, dependent on the softening temperature of the inner tubes 204. The heat applied and the mandrel support 206 should allow the outer tube 202 to nominally retain its outer and inner diameter characteristics, remaining generally cylindrical, while distorting the four inner tubes 204 to conform to the shapes of the five interior mandrels 206.

When a vacuum is applied, the pressure internal to the four inner tubes 204 is more than the pressure of the region 222 internal to the outer tube 202 and external to the inner tubes 204. Using a combination of induction and direct flame heating along the tubes 202, 204, the smaller inner tubes 204 will soften and due to the positive relative pressure difference will balloon out slightly to conform to the shape of the mandrels 206. In addition to conforming to the mandrels, the inner tubes 204 will fuse lengthwise to the internal surface 210 of the outer tube 202 creating a single monolithic structure.

Once the inner glass tubing 204 conforms to the mandrel 206, the fused structure and mandrel 206 are allowed to cool. During this phase, the mandrel 206 contracts more strongly than the fused substrate, so that the mandrel 206 can be easily removed.

The ideal quadrupole has a uniform electric field down the central axis of the quadrupole. The uniform field is set up by electrodes a fixed distance from the central axis ($r_o$). The structure is cut to length preserving the most uniform section of the structure. The ends can be ground or otherwise smoothed. Trimming the fused structure yields the cross section illustrated in FIG. 2D.

Figure 1:
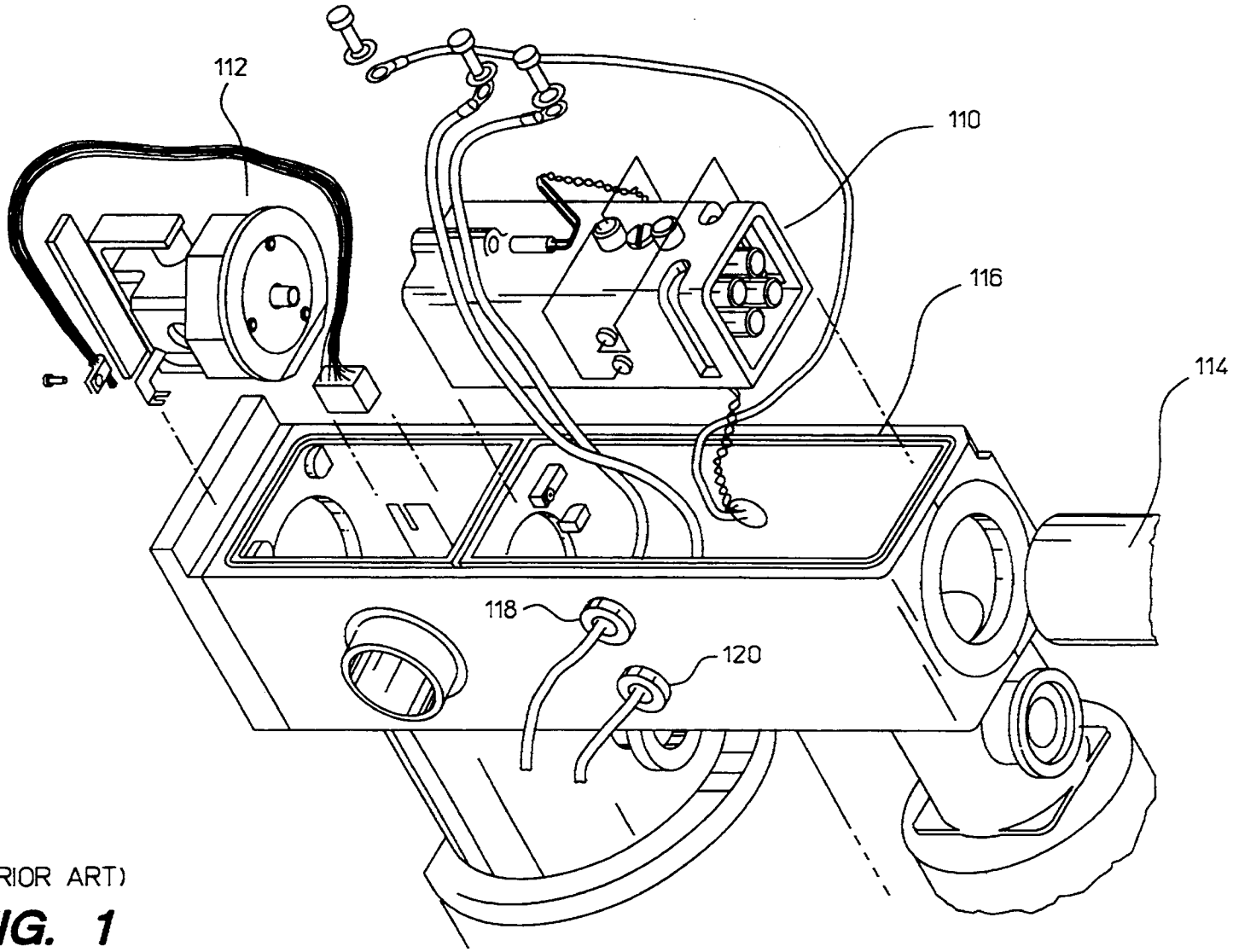
(PRIOR ART) FIG. 1
FIG. 1 illustrates an isometric view of a mass filter including a four rod metal quadrupole assembly and its vacuum chamber.

Mass filters analyze the chemical composition of matter by using electric fields to filter ionized particles by their mass-to-charge ratios. Mass filters typically include four parallel electrodes driven by a radio-frequency power amplifier. One pair of electrodes is driven with a selected RF signal summed with a positive DC potential; the other pair of electrodes is driven by an RF signal 180 degrees out of phase with that applied to the first pair, and is summed with a negative DC. In the embodiment shown in FIG. 1, the electrical interconnection to the power supply is through wires 118, 120 connected to the electrodes which go through the vacuum chamber 116 to the power supply (not shown). In contrast, in the present invention since the outer tube 202 is used to support a vacuum, electrical connection may be made directly through the sidewall of outer tube to the four electrodes. In the present invention, the conductive surface of the second region 228 of the four structures 204 fused internal to the outer tube 202 function as electrodes.

Figure 2C:
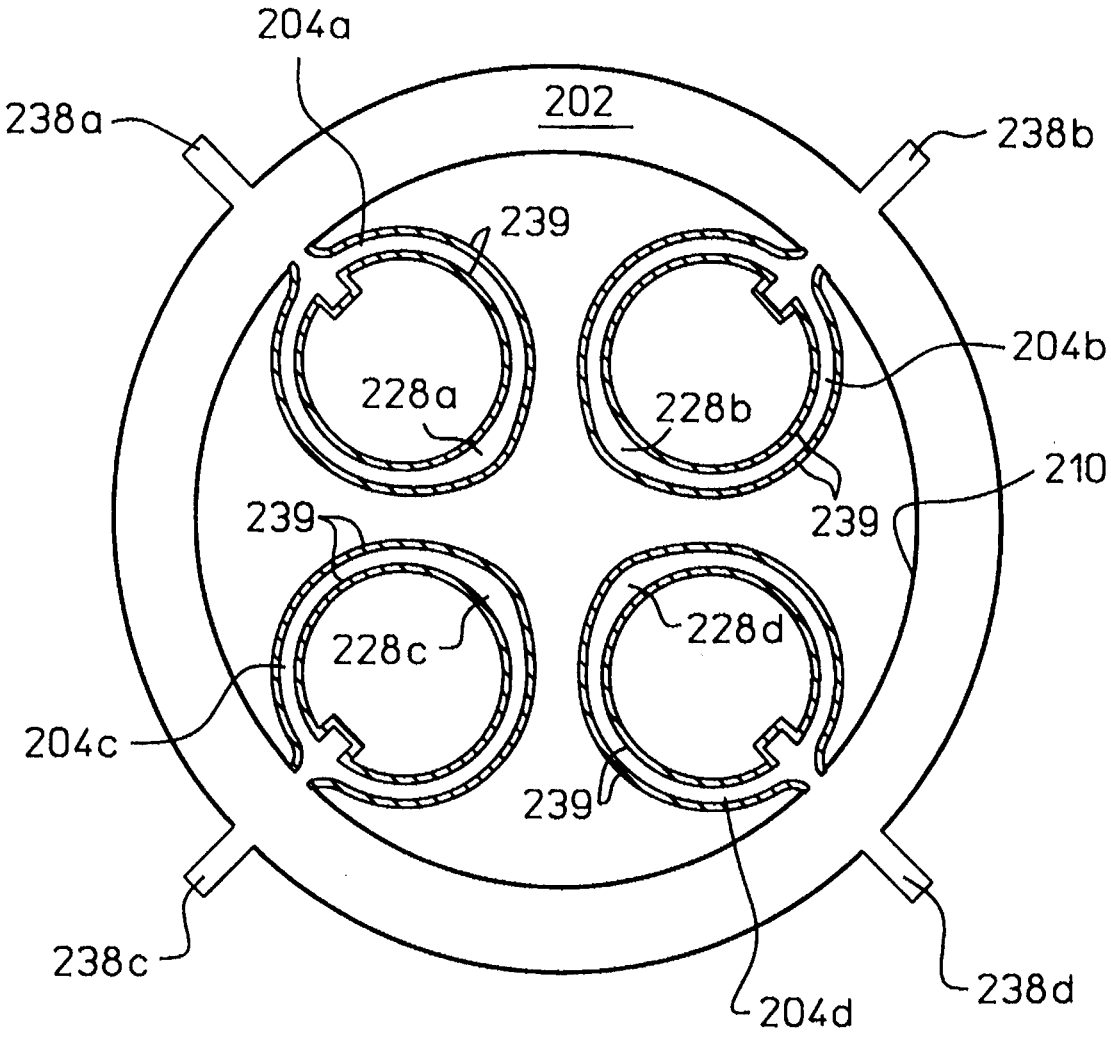
Figure 2D:
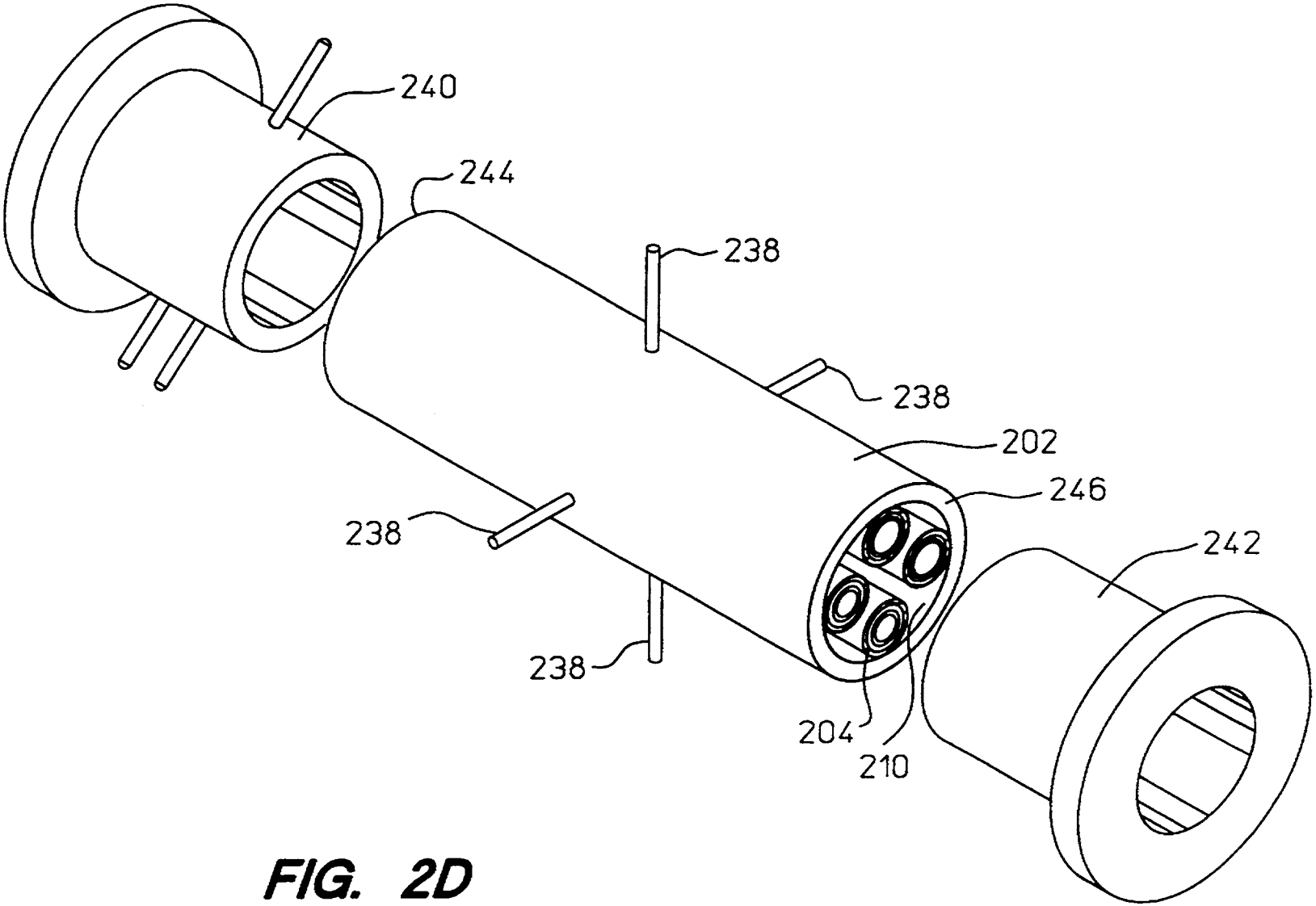
Figure 2E:
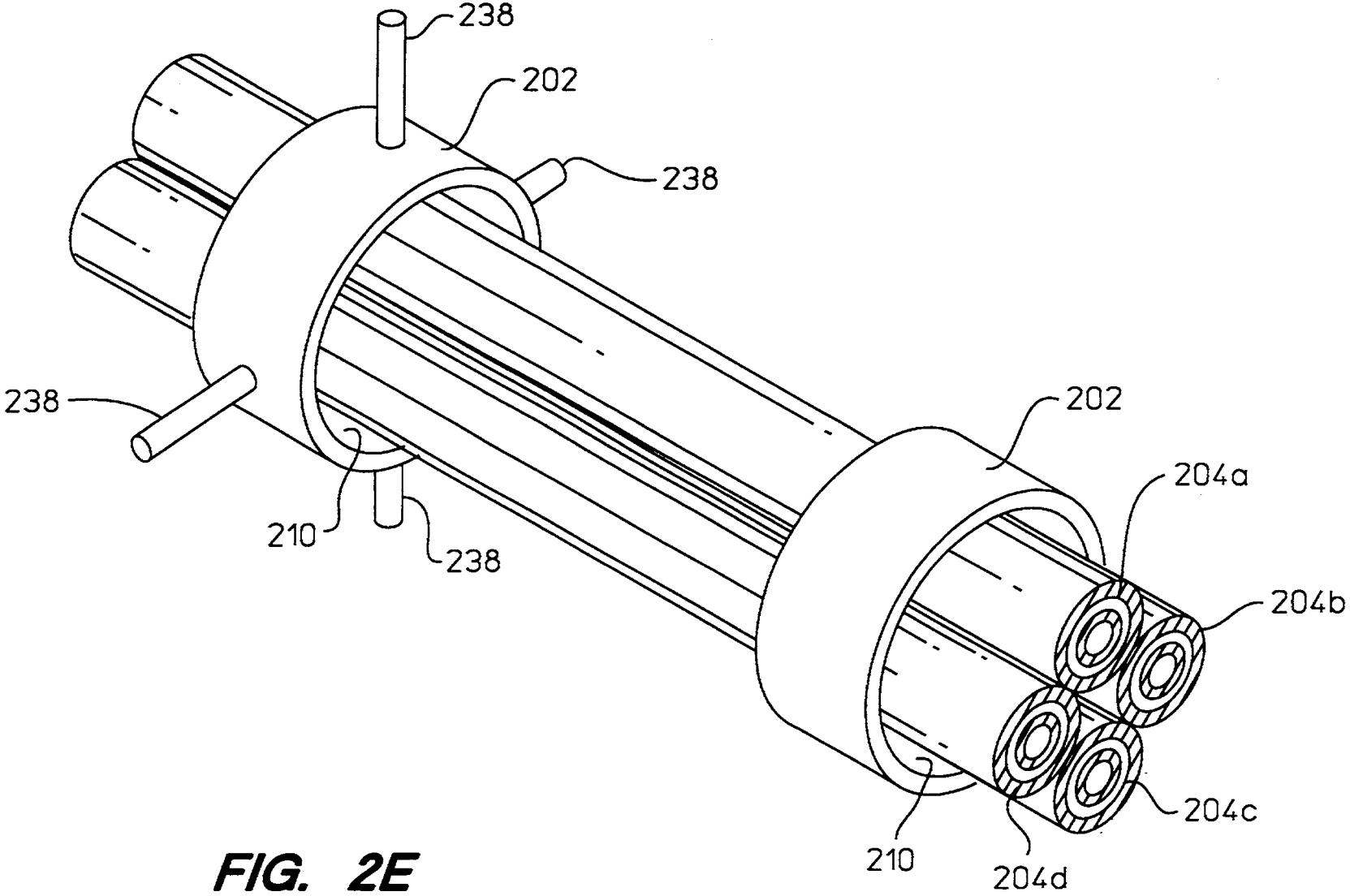

FIGS. 2C and 2D illustrate the resultant structure after the step of fusure of the four inner tubes 204 to the internal surface of the outer elongate tube 202 and the fusure of the metal feedthroughs 238 through the outer tube 202 and the inner tubes 204. A signal is applied to the mass filter through preformed metal feedthroughs 238*a*, 238*b*, 238*c*, 238*d*. The metal feedthrough pins 238 correspond to the four electrodes and provide electrical interconnection from the electrodes to the power supply. The feedthrough pins 238 typically are comprised of a conductive medium or coated with a conductive medium. As illustrated in FIG. 2C, the feedthrough pins 238 extend through the internal surface 210 of the outer glass tube 202 to make an electrical connection with the conductive surface 228 of the electrode. The metal pins 238 also extend outwardly from the external surface 208 of the outer elongate glass tube 202.

In the embodiment shown in FIG. 2C-2D, electrical interconnection to an external power source involves the steps of: fusing a conductive medium to the outer elongate tube and to each of the four structures, wherein the conductive material extends outwardly from the external surface of the outer elongate tube; and applying a conductive material to at least a portion of the four structures.

In the preferred embodiment the outer elongate tube and the four structures are comprised of a dielectric and the conductive material extending through the outer elongate tube and the four structures are metal feedthrough pins. In order to insert the metal feedthrough pins through the outer elongate tube and the four structures, the outer elongate tube is spot heated in the vicinity where placement of the metal feedthrough pins is desired. Local heating of the outer elongate tube also softens the four structures internal to the outer tube so that the metal feedthrough can be pushed through both the inner and outer tubes. In the embodiment shown in FIGS. 2C and 2D, the metal feedthrough pins are positioned through each of the four structures corresponding to each of the four electrodes of the quadrupole.

After the metal pins are fused to the outer elongate tube and the four structures, a conductive material is deposited on the surface of the inner tubes. In order to limit the regions where the conductive materials are applied, regions where the deposition of the conductive material is not desired are mechanically masked to prevent deposition of the conductive material. In the present embodiment, a mechanical mask (not shown) is applied to the internal surface of the outer quartz tube, leaving the internal and external surfaces of the inner tubes exposed. In one embodiment, the conductive material is applied by chemical vapor deposition. The deposited metal film covers the internal and external surfaces of the inner tubes, the ends of the inner tubes, and the flush ends of the metal feedthrough pins. The deposited metal couples the conductive regions of the inner tubes (the electrodes) to the metal feedthrough pins, thus providing electrical connection from the electrode to the exterior of the vacuum chamber.

The metal feedthrough 238 extends through the sidewall of the outer tube 202 until the metal feedthrough 238 reaches where the conductive region of the four structures will be subsequently formed. In the embodiment previously described, the inner four structures 204 are glass elongate tubes. The conductive surface is formed by depositing a metal layer 239 in the unmasked regions of the structure. The conductive surface is formed at least in the second arced region 228 of the four structures, however it may extend past the second arced region. For example, in the embodiment shown in FIG. 2C and 2D, the mask only covers the internal surface of the outer tube. Thus, the conductive surface of the four structures covers the entire internal surface of the four inner tubes, both end surfaces of each of the inner tubes, the entire external surface of the inner tubes, excluding the region where the where the inner tube is fused to the outer tube.

Referring to FIG. 2D, pre-fabricated upper and lower flange pieces 240, 242 may be coupled to the ends 244, 246 of the outer elongate tube 204. The quadrupole assembly of the mass filter is typically connected to an ion source and ion detector. Typically the upper flange 240 is connected to the ion detector while the lower flange 242 is connected to the ion source. The upper and lower flange pieces 240, 242 provide a modular design which easily allow different ion sources and ion detectors to be coupled to the quadrupole assembly.

In the embodiment shown in FIG. 2D, the outer elongate tube 202 is used as the outermost structure for supporting the vacuum. In FIG. 2D, the length of the outer elongate tube 202 is approximately the length of the four structures 204. Although there must be at least one outer elongate tube in an alternative embodiment shown in FIG. 2E, a series of outer elongate tubes having a length less than the length of the four structures is used to replace the unitary outer elongate tube shown in FIG. 2D. The series of outer elongate tubes is fused to the four structures and placed inside of a vacuum.

In the second embodiment, the quadrupole having four structures fused internal to the outer tube is formed by the process which includes the steps of: positioning an outer elongate tube inside a mold, positioning four structures inside the elongate outer tube, the elongate outer tube having at least one open end, the four structures having two closed ends, the four structures being positioned so that the base region of the four structures contacts or nearly contacts the internal surface of the outer elongate tube, placing the outer elongate tube inside a furnace, and fusing the four structures to the outer elongate tube.

The steps of the second embodiment for formation of the glass quadrupole is similar to the process described in the first embodiment, with two primary differences. First, in the second embodiment the positioned outer and inner tubes are placed inside a mold prior to placement in a furnace. Further, in the second embodiment the four structures positioned inside the elongate outer tube are closed on both ends.

Figure 3:
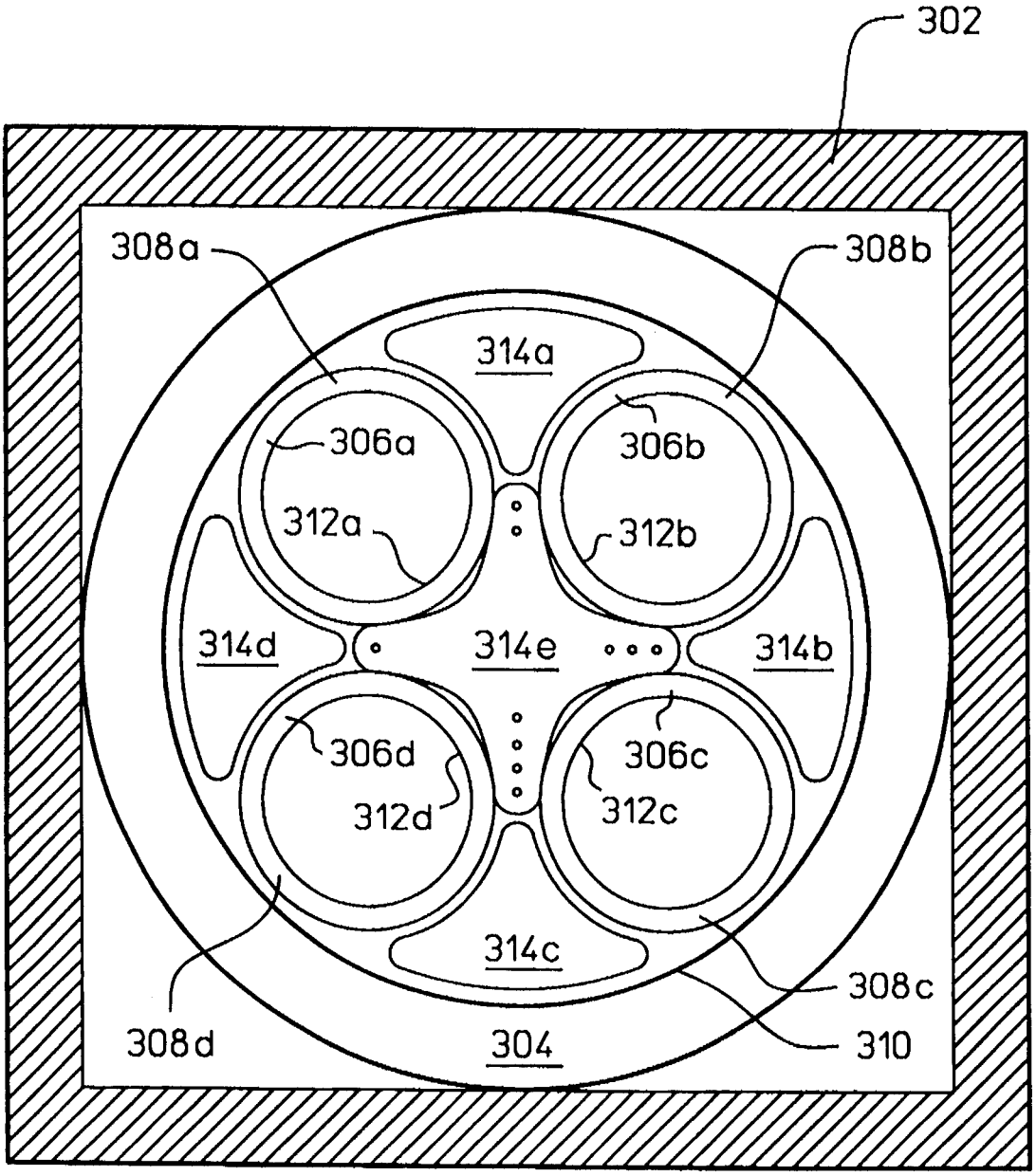
FIG. 3 illustrates a cross sectional view of the outer quartz tube and four inner structures positioned inside a mold according to a second embodiment of the present invention.

In the second embodiment, the outer tube and the four inner structures are placed inside a mold. The mold is typically made of a material whose softening point is higher than the softening point of the outer tube. FIG. 3 illustrates a cross sectional view of the mold 302 including an outer tube 304 and four inner structures 306*a*, 306*b*, 306*c*, 306*d* positioned inside of the mold 302. In the second embodiment, the four structures 306 positioned internal to the outer glass tube 304 are typically four elongate glass tubes closed on both ends. Because the outer elongate tube 304 is not used to support a vacuum, the outer elongate glass tube 304, unlike the first embodiment, can be open on both ends. Unlike the first embodiment, the four inner structures 306 used are closed at both ends. The internal pressure of the inner tubes 306 is typically around one atmosphere at STP (standard temperature and pressure) although pressure may vary. The closed inner tubes 306 are formed using techniques well known in the art.

The four structures 306*a*, 306*b*, 306*c*, 306*d* are positioned so that their corresponding base regions 308*a*, 308*b*, 308*c*, 308*d* of the four structures are proximate to the internal surface 310 of the outer elongate glass tube 304 and a second arc region 312 faces the central axis of the outer elongate glass tube. Similar to the first embodiment, mandrels 314*a*, 314*b*, 314*c*, 314*d*, 314*e* are positioned inside the outer elongate glass tube 304. A central mandrel 314*e* is placed proximate to the second region 312 of the four structures. Four side mandrels 314*a*, 314*b*, 314*c*, 314*d* are placed between the four structures 306 to prevent contact of the future conductive areas of the second region of the four structures.

The mold 302, holding the positioned outer and internal structures 304, 306, is placed inside a furnace. The furnace temperature is raised to at least the softening point of the elongate glass inner tubes. Because the softening temperature of the inner tubes is approximately 2 to 7 times absolute room temperature, the internal pressure of the four inner tubes 306 will rise to approximately 2 to 7 times their initial internal pressure at room temperature. Thus, the internal pressure of the inner glass tubes 306 is greater than the pressure in the region internal to the outer tube and external to the inner tubes. The pressure differential causes the inner glass tubes 306 to expand outwardly and contact the mandrel surfaces. Since the inner tubes are at their softening point, the surface of the inner tubes conforms to the mandrel surface and fuse lengthwise to the internal surface of the outer tube 202. In the preferred embodiment, the surface of the mandrel in proximity to the inner tubes is generally hyperbolic in cross section. Thus the electrode surface of the quadrupole, formed by the surfaces of the inner tubes 204, is hyperbolic.

Similar to the first embodiment, after the four inner structures 306 are fused to the outer glass tube 304, the quadrupole may be cut to provide the most uniform section resulting in the fewest discrepancies in the electric field along the central axis of the quadrupole. Similar to the process flow for the first embodiment, after cutting the quadrupole, metal feedthrough pins are fused through the outer elongate tube to contact the internal surface of the inner tubes. After fusing the feedthrough tubes, a metal layer is added to achieve electrical contact. Typically the metal layer is applied by chemical vapor deposition.

In a third embodiment the process flow for manufacturing the electrode assembly includes the steps of: modifying the surface of the four structures, positioning the four structures internal to an outer elongate tube, the four structures being positioned so that the modified surfaces of the four structures are aligned in parallel equidistant opposing pairs with a common central axis, and fusing the four structures to the outer elongate tube.

The process steps of the third embodiment are similar to the process steps of the first and second embodiment. However, instead of performing the step of forming a first surface on the four structures simultaneously with the step of fusing the four structures to the outer elongate surface, the two steps are performed consecutively. Typically, the step of forming a first surface of the four structures is performed prior to the fusing step. Although in the preferred embodiment, the first surface is a hyperbola, other surfaces may be used. For example, the first surface may be circular or elliptical in cross section.

Figure 4A:
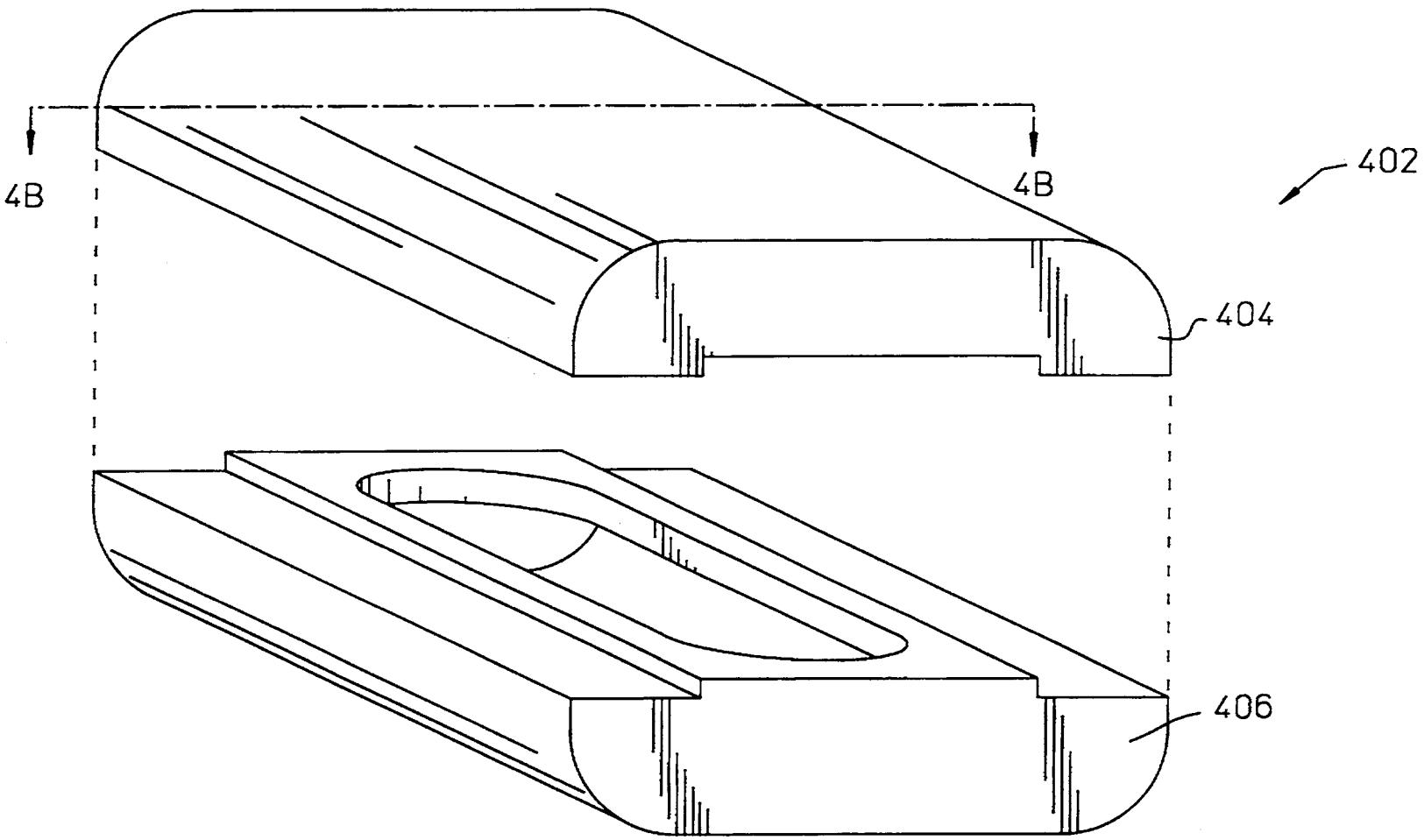
FIGS. 4A–4B illustrate an isometric and cross sectional view of a mold used in formation of a single preformed hyperbolic structure.
Figure 4B:
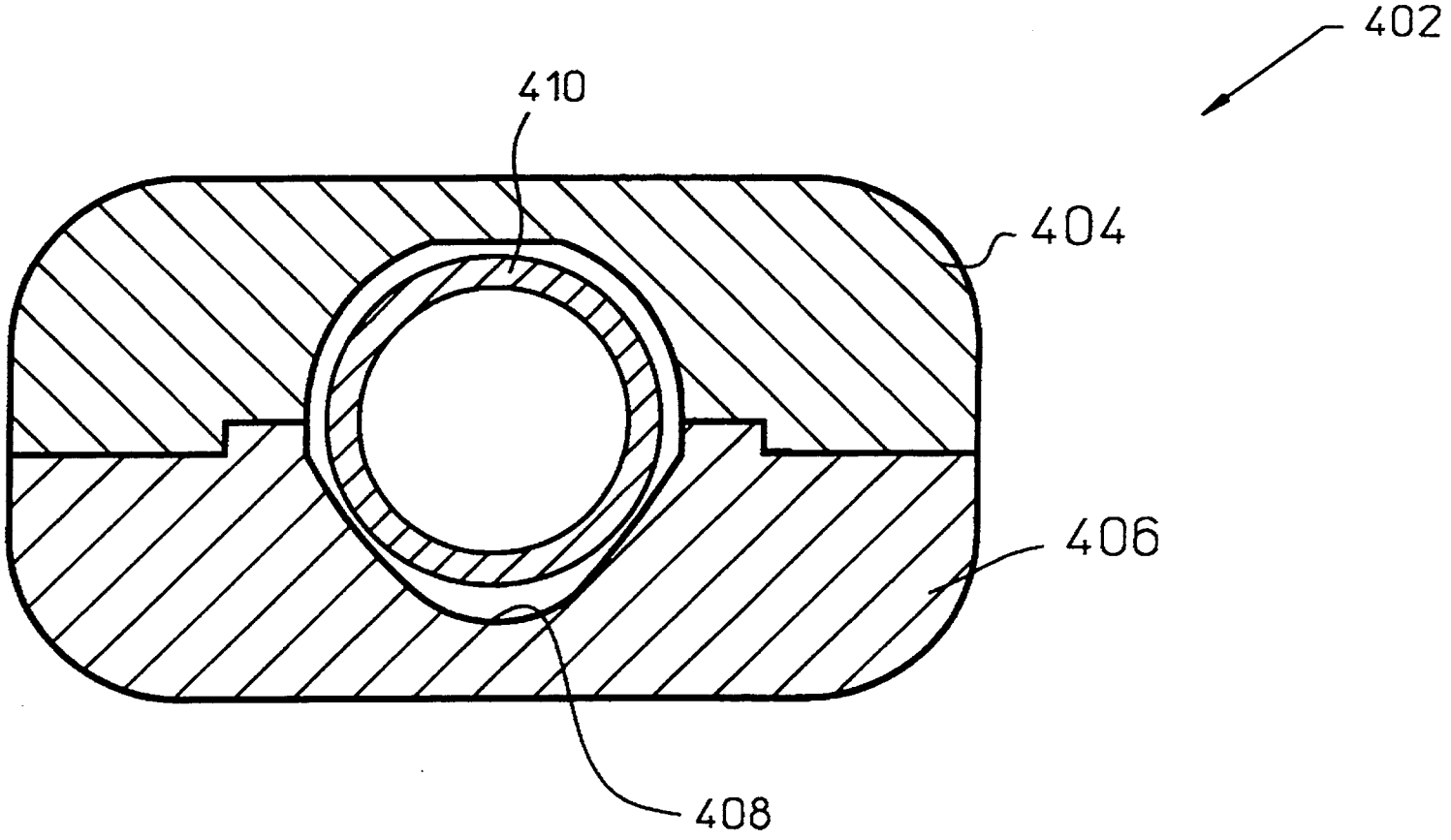

The four structures are typically formed individually using a mold having a hyperbolic surface. Alternatively, a single mold for formation of a hyperbolic surface for all four structures may be used to preform a hyperbolic surface on the four structures simultaneously. FIG. 4A shows an isometric view of the mold used in individually preforming a hyperbolic structure. FIG. 4B shows a cross-sectional view of the mold used in forming the hyperbolic structure. The mold 402 is typically comprised of two pieces: a first piece 404 and a second piece 406 including a hyperbolic surface 408. The mold 402 is typically comprised of a ceramic material but may be comprised of any material having a lower thermal expansion than the structures placed inside the mold 402.

A glass structure 410 is inserted inside of the mold 402. In the preferred embodiment, the structure 410 is a glass tube generally circular in cross section and closed at both ends. After insertion of the structure 410 inside the mold 402, the mold 402 is placed inside a furnace. As the structure 410 reaches its softening point, the trapped air inside expands causing the structure 410 to conform to the interior surface of the mold. Thus the structure 410 expands to conform to the hyperbolic surface 408 of the mold 402 thus forming a hyperbolic contour on the surface of the structure 410.

In an alternative embodiment, mold is inserted into a chuck (not shown) which is coupled to a lathe (not shown). In the alternative embodiment, each of the four structures 410 is a glass tube having an open end and a closed end. The lathe turns the chuck to apply heat equally to the surface of the mold, evenly heating the mold and the glass structure inside the mold to the softening temperature of the glass structure. Attached to the open end of the glass structure 410 is tubing. As the glass structure 410 reaches its softening point, air is blown into the tubing forcing the glass structure 410 to expand to conform to the hyperbolic surface of the mold.

Although in the preferred embodiment, the four structures are cylindrical in form, other forms may be used. The critical constraint is to provide an arced, preferably hyperbolic shape which will support a symmetrical electric field about an axis. In the embodiment shown in FIG. 4D, a hyperbolic shape is preformed on an angled structure 420 instead of the cylindrical tubes 412 shown in FIG. 4C.

Figure 4C:
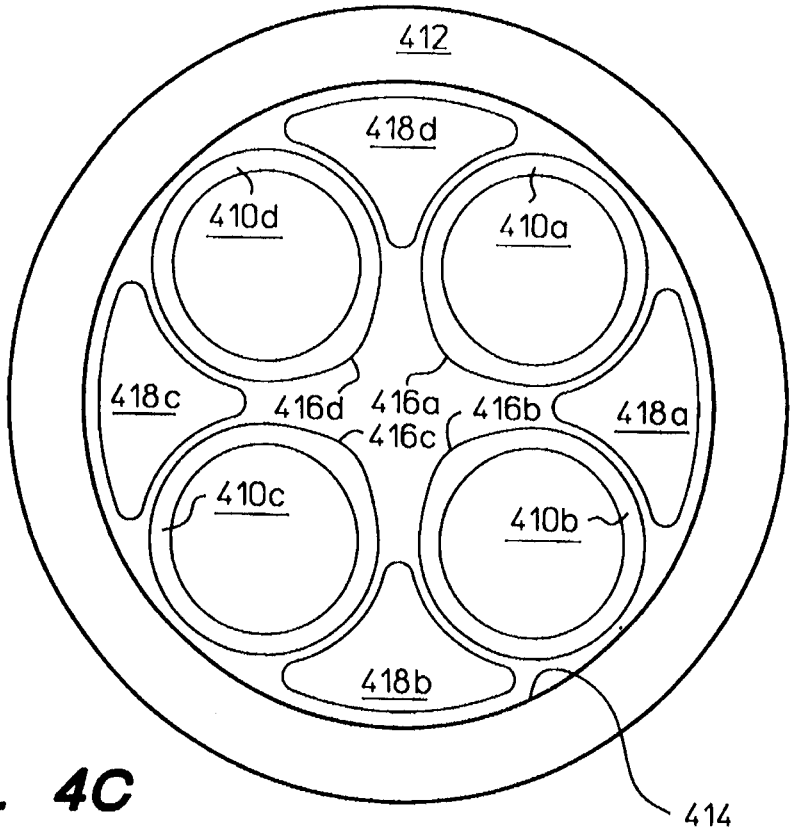
FIGS. 4C–4F illustrate alternative embodiments of preformed hyperbolic structures according to a third embodiment of the present invention.
Figure 4D:
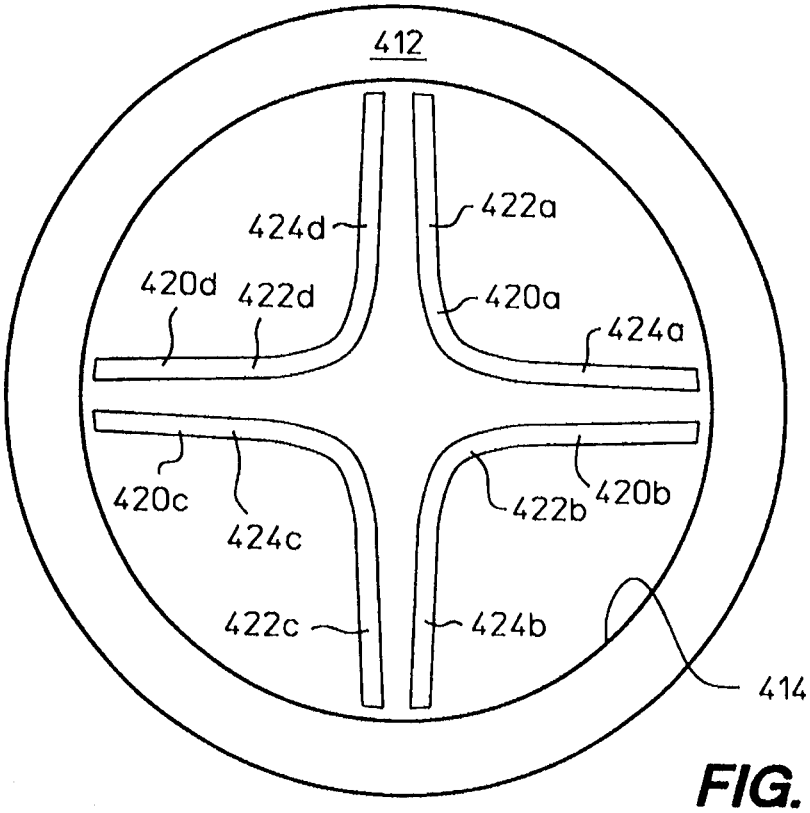

The embodiment shown in FIG. 4D shows the angled structure prior to fusure of the structure to the outer elongate tube 412. The angled structures 420*a*, 420*b*, 420*c*, 420*d* include a first member 422*a*, 422*b*, 422*c*, 422*d* which is at a predetermined angle with a second member 424*a*, 424*b*, 424*c*, 424*d*. In the embodiment shown in FIG. 4D, the angle between the first and second members 422, 424 of the angled structure 420 is approximately 90 degrees. The angled structures 420 are positioned so that the 90 degree angle is facing the internal surface 414 of the outer elongate tube 412.

Figure 4E:
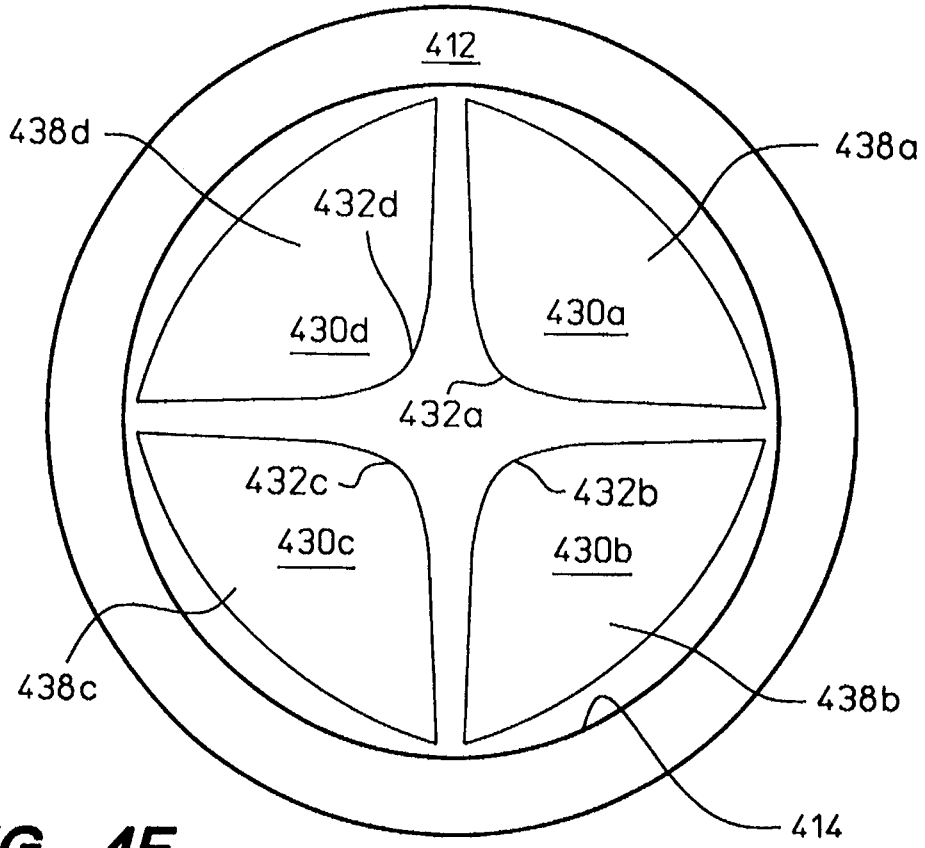

In an alternative embodiment shown in FIG. 4E, the four structures 430*a*, 430*b*, 430*c*, 430*d* are closed figures which are generally triangular in form. The second region 432*a*, 432*b*, 434*c*, 434*d* aligned with a central axis is preformed to be generally hyperbolic in shape. The base region 438*a*, 438*b*, 438*c*, 438*d* of the triangular form is fused to the internal surface 414 of the outer tube 414. The triangular form may be solid or open in its interior. Although the solid configuration has better ruggedness than an open configuration, an open configuration has better conductance for use as a vacuum.

Figure 4F:
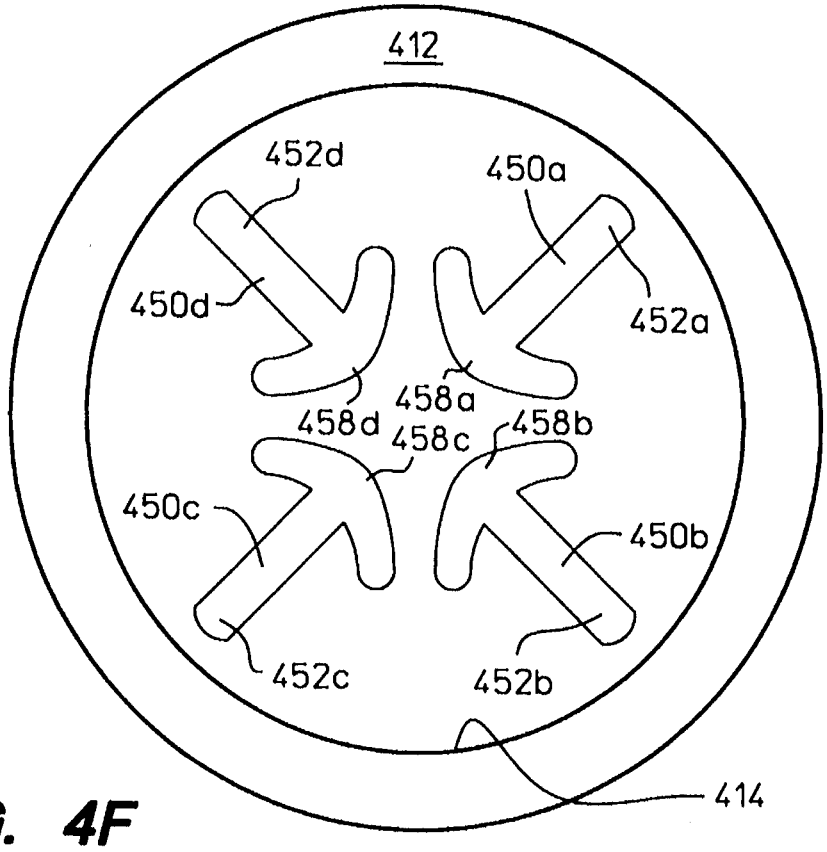

In the embodiment shown in FIG. 4F, the four structures 450*a*, 450*b*, 450*c*, 450*d* are mushroom shaped. The four structures 450 include a base region 452*a*, 452*b*, 452*c*, 452*d* fused to the internal surface 414 of the outer tube 412 and a cap region 458*a*, 458*b*, 458*c*, 458*d* having a curvature. The capped region 458 typically has a hyperbolic surface. A metal layer is deposited over at least a portion of the four structures. In the preferred embodiment, the metal layer extends past the top surface of the cap to the underside of the capped shaped structure. Extending the metal layer means that the pole-dielectric interface is not in the line of sight of the central axis of the quadrupole. Thus, the effect of the charge distortion on the electric field is decreased.

After formation of the preformed surface, a metal layer is formed on the surface of the four structures. The metal layer is typically formed by chemical vapor deposition. Alternatively, the metal layer may be formed by bonding thin metal strips to the surface of the four structures as is described in U.S. Pat. No. 4,885,500. In the preferred embodiment, the metal layer is formed on the surface of the four structures before fusing the four structures to the outer elongate tube. However, the metal layer may be deposited after fusing the four structures inside the outer elongate tube.

After preforming a hyperbolic curvature on the surface of the four structures 410, the four structures 410 are positioned so that they contact or nearly contact the internal surface of the outer elongate glass tube. FIG. 4C shows a cross-sectional view of an embodiment where the four inner structures 410 are glass elongate tubes having a preformed hyperbolic surface. In FIG. 4C the preformed four structures 410*a*, 410*b*, 410*c*, 410*d* are positioned inside of the outer elongate tube 412 prior to fusure of the preformed structures 410 to the internal surface 414 of the outer elongate tube 412. Placement of the preformed structures 410 is critical, since tolerances are in the range of 200 microinches. Mandrels 418 may be placed between the four structures 410 to aid in the accurate positioning and fusure of the inner tubes 410 to the outer elongate tube 412.

The four structures 410 are positioned internal to the outer tubes 412 so that the respective preformed hyperbolic surfaces 416*a*, 416*b*, 416*c*, 416*d* of the four structures 410*a*, 410*b*, 410*c*, 410*d* are aligned in parallel opposing pairs equidistant around a central axis. Specifically, preformed hyperbolic surface 416*a* forms a parallel opposing pair with preformed hyperbolic surface 416*c* and preformed hyperbolic surface 416*b* forms a parallel opposing pair with preformed hyperbolic surface 416*d*.

The four structures 410 are fused to the internal surface 414 of the outer elongate tube 412. The term fusure may be used to refer to any manner which binds or mechanically couples two structures together in a mechanically stable fashion. The inner tubes 410 are fused to the outer tube 412 by a ceramic adhesive or fiber optic grade epoxy. Alternatively, the four structures 410 may be fused to the outer tube using heat. Instead of being fused along the entire length of the inner structures 410, the four structures 410 may be spot fused only in predetermined zones, typically at both ends of the outer elongate tube 412. When spot fusing, the direct flame heater or laser beam is not moved along the entire length of the outer elongate tube 412 and the four structures 410. Instead, the heat is placed only in the predetermined area where fusing is desired. After the fusure is complete, the heat is moved to the next area where fusing is desired. Spot fusing is thought to decrease the formation period without appreciably decreasing the performance characteristics of the mass filter.

Similar to the first embodiment, after the four inner structures 410 are fused to the outer tube 412, the quadrupole may be cut to provide the most uniform section resulting in the fewest discrepancies in the electric field along the central axis of the quadrupole. Alternatively, individual tubes may be cut first and then positioned or not cut at all. This is especially true when using a series of outer elongate tubes as support rings to support the four electrode structures. Similar to the process flow for the first embodiment, after cutting the quadrupole, metal feedthrough pins may be fused through the outer elongate tube to contact the internal surface of the inner tubes.

In a fourth embodiment, the quadrupole is formed by the process including the steps of: fusing a metal feedthrough pin to the four structures, positioning the metal feedthrough pin through the opening in the outer elongate tube, the metal feedthrough pin being positioned to place a first region of the four structures in parallel opposing pairs equidistant from a central axis; and fusing the metal feedthrough pin internal to an outer elongate tube.

Figure 5:
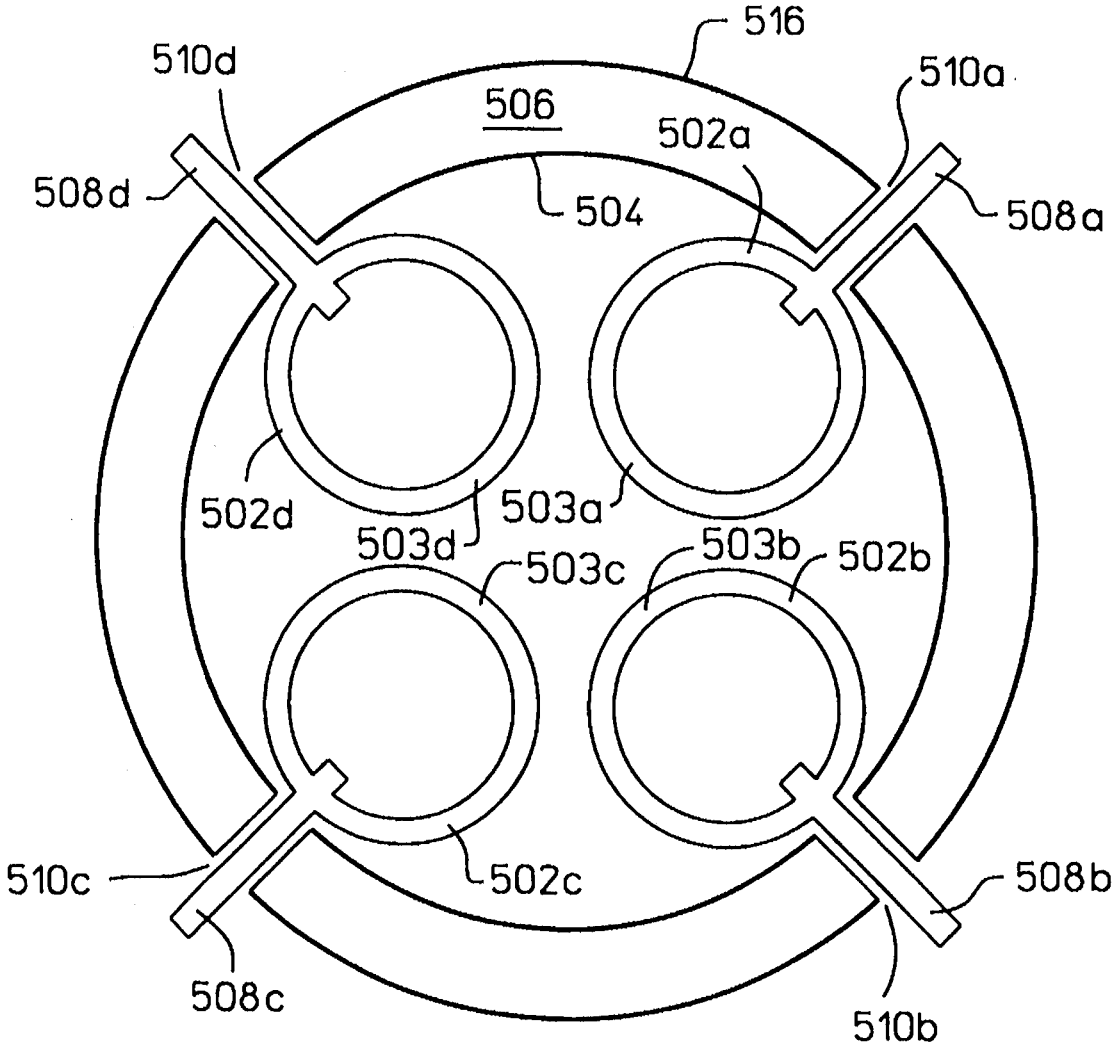
FIG. 5 illustrates a cross sectional view after the steps of fusing the metal feedthrough conductor to the four structures but before fusing the metal feedthroughs to the outer elongate tube according to a fourth embodiment of the present invention.

In the embodiment shown in FIG. 5, the four structures 502*a*, 502*b*, 502*c*, 502*d* are elongate tubes. Similar to the previously described embodiments, the four structures 502 are fused to the outer elongate tube 506. In the present embodiment, the metal feedthroughs 508*a*, 508*b*, 508*c*, 508*d* are fused or otherwise fixed to the corresponding four structures 502*a*, 502*b*, 502*c*, 502*d* before positioning the four structures 502 inside the outer elongate tube 506.

FIG. 5 shows a cross sectional view of the fourth embodiment of the present invention after the steps of fusing the metal feedthrough pins to the four structures and positioning the metal feedthroughs through the opening in the outer elongate tube, but before fusing the metal feedthroughs to the outer elongate tube. Before positioning the metal feedthroughs 508 through the outer elongate glass tube 506, four openings 510*a*, 510*b*, 510*c*, 510*d* corresponding to the four structures 502*a*, 502*b*, 502*c*, 502*d* are formed through the sidewall of the outer elongate tube 506. The openings 510 may be formed mechanically by grinding an opening through the sidewall of the outer elongate tube 506 or by cutting the openings 510 using a laser, or by flame heating and piercing an opening.

In some cases, placing the metal feedthroughs 508 through the openings 510 in the outer elongate tube 506 will not align the conductive surfaces with sufficient accuracy. In those cases, positioning pieces (not shown) are inserted inside the outer tube 508 between the four inner tubes 502 typically after placement of the four structures 502 inside the outer elongate tube. The positioning pieces ensure that the four inner tubes 502 are correctly placed before fusing to the sidewall of the outer tube 506.

In the embodiment shown in FIG. 5, the four structures 502 are comprised of metal. However, the four inner structures 502 can alternatively be comprised of a dielectric such as quartz or borosilicate glass. Having the four structures composed of a conductive material, eliminates the need for application of a metal layer and potentially eliminates a masking step and metal deposition step.

It is understood that the above description is intended to be illustrative and not restrictive. For example, a number other than four may be used for the electrode structures internal to the outer elongate tube. The important criteria is to provide the proper number of electrodes necessary for supporting a uniform field which will give the desired sensitivity range. In addition, the conductive layer formed on the electrode surface may be formed by chemical, physical or other deposition methods, plating, or by bonding or fusing thin foils or tapes to the electrode surface. Further, the electrode structures and the outer tube may be comprised of either a dielectric material or a conductive material. Additionally, fusure of the electrode structure to the outer tube can be accomplished by any means which binds or couples the electrode structure to the outer tube in a mechanically stable fashion. Further, a series of outer elongate tubes may be used to replace a single outer elongate tube as the support structure for the electrode. Further, although in the preferred embodiment, the arced surface of the electrode is hyperbolic other surfaces are possible. For example, the electrode surface may be circular or elliptical or any shape which will support a uniform field which will give the desired sensitivity. Further, the four electrode structures may be closed on both ends or solid. The scope of the invention should therefore be determined not with reference to the above description, but instead should be determined with reference to the appended claims, along with the full scope of equivalents to which such claims are entitled.

What is claimed is:

1. A method of formation of an electrode in a mass filter electrode assembly comprising the steps of:

placing a structure in proximity to a first surface; and modifying the shape of a structure by heating the structure to its softening point, wherein responsive to a pressure differential the structure expands to conform to the first surface.

2. The method recited in claim 1 further including the step of:

positioning at least four structures inside an outer elongate tube, the at least four structures including an arced region, the arced region of the at least four structures being aligned in parallel equidistant opposing pairs around a central axis.

3. The method recited in claim 1 wherein the positioning step occurs before the modifying step, and further wherein the first surface is the surface of a central mandrel placed in proximity to the at least four structures.

4. The method recited in claim 1 wherein the positioning step occurs after the modifying step, and further wherein the first surface is the surface of a mold.

5. The method recited in claim 1 wherein the first surface is generally hyperbolic in cross-section.

6. The method recited in claim 1 further including the step of placing a metal layer on the structure.

7. The method recited in claim 6 wherein the step of depositing a metal layer is preceded by the step of applying a mask to prevent the deposition of the metal layer in undesired areas.

* * * * *